US006481326B2

(12) United States Patent
French

(10) Patent No.: US 6,481,326 B2
(45) Date of Patent: Nov. 19, 2002

(54) CUTTING ASSEMBLY AND RELATED APPARATUSES

(75) Inventor: John Robert French, Melton Mowbray (GB)

(73) Assignee: J R French Limited, Leicestershire (GB)

( * ) Notice: Subject to any disclaimer, the term of this patent is extended or adjusted under 35 U.S.C. 154(b) by 0 days.

(21) Appl. No.: 09/915,085

(22) Filed: Jul. 25, 2001

(65) Prior Publication Data

US 2002/0017040 A1 Feb. 14, 2002

Related U.S. Application Data

(63) Continuation of application No. PCT/GB99/04440, filed on Dec. 29, 1999.

(51) Int. Cl.[7] ..... B64D 1/04

(52) U.S. Cl. ..... 89/1.13; 83/928; 83/663; 83/673; 83/675

(58) Field of Search ..... 89/1.13; 83/928, 83/662, 663, 664, 665, 673, 675

(56) References Cited

U.S. PATENT DOCUMENTS

| | | | | |
|---|---|---|---|---|
| 1,456,860 A | 5/1923 | Turner | ..... | 97/215 |
| 2,679,200 A | 5/1954 | Johnson et al. | ..... | 97/215 |
| 3,771,413 A | 11/1973 | Sieg et al. | ..... | 89/1.13 |
| 3,937,408 A | 2/1976 | Buck | ..... | 241/282.2 |
| 5,345,848 A | 9/1994 | Knecht | ..... | 83/663 |

FOREIGN PATENT DOCUMENTS

| | | |
|---|---|---|
| DE | 195 13 450 C1 | 4/1996 |
| DE | 197 11 544 A1 | 9/1998 |
| DE | 197 24 753 A1 | 12/1998 |
| EP | 0 224 371 | 6/1987 |
| EP | 0 288 024 | 4/1988 |
| EP | 0 420 731 A1 | 4/1991 |
| EP | 0 850 689 A1 | 12/1997 |
| GB | 827999 | 2/1960 |
| GB | 2 153 192 A | 8/1985 |

*Primary Examiner*—J. Woodrow Eldred
(74) *Attorney, Agent, or Firm*—Fish & Richardson P.C.

(57) ABSTRACT

In the field of clearance of unexploded ordnance from land, there is a need for an improved apparatus for removing unexploded ordnance from the ground. A cutting apparatus includes a plurality of blades on a rotatable shaft, the blades being tapered towards their distal ends. When the blades are driven forwardly through soil while the shaft rotates, they tend to loosen items such as solid ordnance and bring such items to the soil surface. The blades simultaneously sever scissile matter in the soil, thereby facilitating removal of the ordnance. The cutting assembly includes a conveyor for conveying unexploded ordnance away from the soil. The cutting assembly may be mounted on a vehicle including further means for rendering harmless the unexploded ordnance.

26 Claims, 7 Drawing Sheets

CUTTING ASSEMBLY AND RELATED APPARATUSES

This is a continuation of PCT Application Ser. No. PCT/GB99/04440, filed Dec. 29, 1999, which claims priority from Great Britain Application Ser. No . 9901997.8, filed Jan. 30, 1999.

This invention concerns a cutting assembly and to related apparatuses such as a vehicle having such a cutting assembly mounted thereon. Such apparatuses are useful in the clearance of landmines and other unexploded ordnance.

As used herein the term "ordnance" includes, but is not limited to, landmines, fragments of landmines, shells and fragments thereof, detonators, grenades and rockets.

Clearance of ordnance in general, and landmines in particular, is a subject that affects the lives of millions of people worldwide. It is well known that armies commonly lay thousands of mines at a time. This creates lethal minefields that often affect civilians more than they affect military personnel. The minefields usually remain highly hazardous to pedestrians and vehicles long after the cessation of armed conflict in an area.

The clearance of ordnance is a laborious process that presents serious risks to the individuals involved in it. The most commonly practised method of landmine clearance requires a pedestrian, protected by little more than a helmet and an armoured vest, repeatedly to prod at the ground with a rigid stick that is intended to locate unexploded ordnance by feel.

Aside from the risk of the individual accidentally treading on a mine during the clearance operation, this method is often unreliable for various reasons. These include that of variations in the depths to which the stick is inserted into the ground; and that the small contact area of the end of the stick, that is necessary for easy insertion of the stick into the ground, makes it easy to miss ordnance and leave it, unexploded, in the ground. Also, this method is difficult to practise in frozen ground. Freezing of the ground often hampers landmine clearance in the states formerly known as Yugoslavia, for example.

Patent application number EP-A-0 842 388 discloses an apparatus for detonating landmines.

The apparatus of EP-A-0 842 388 is highly effective in detonating landmines reliably and safely, but detonation alone does not render modern minefields safe. This is because the device of EP-A-0 842 388fails to detonate some mines, as a result of faults in the mines or the presence of unremoved safety devices; and some unexploded ordnance, hand grenades, mortars, shells, rockets, etc. Such devices are liable to cause death and injury to people who come into contact with them.

Many modern designs of landmine (such as anti-personnel mines manufactured from plastics materials) are intended to fragment on detonation into pieces that are perhaps 10%–50% of the size of an intact mine. It is known to use a flail machine, as an alternative to the apparatus of EP-A-0 842 888, for detonating ordnance. Sometimes the flail machine may fragment a mine without detonating it. This leads to the presence of comparatively large mine fragments, connected to operational detonators, in minefields supposedly rendered safe by the flail machine. Such pieces of landmine are highly explosive and remain capable of causing severe injuries to people who tread on or otherwise contact them.

Consequently the United Nations (UN), who have responsibility for many landmine clearance operations, have specified a requirement that clearance processes must be capable of reliably clearing all ordnance from contaminated areas. The UN have also specified that clearance should taken place to a depth of 25 cm where appropriate. However, there are certain areas, in the Falkland Islands for instance, where it may be necessary to clear to depths up to 50 cm.

It is thought desirable that landmine clearance processes must be capable of reliably reducing the size of each piece of ordnance, remaining in or on the ground after a clearance operation, to a maximum diameter of 10 mm. This ensures destruction of known detonators, for example.

Care needs to be taken during clearance that the topsoil and subsoils are not compacted or mixed in such a manner that the land is rendered infertile. This would cause hardship in the communities that landmine clearance is intended to benefit. In general landmines do not, naturally, sink below the topsoil. The depth of necessary clearance will however vary from one extreme, such as a rocky surface, to another, such as a peaty area in the Falkland Islands.

Thus it would be desirable to provide an apparatus for reliably removing and rendering safe all pieces of landmine in a minefield, regardless of their size and location, and regardless of the soil type.

According to a first aspect of the invention, there is provided a cutting assembly comprising a rotatable shaft supporting one or more elongate, arcuate blades, the or each blade having a base portion and a terminal portion remote from the base portion, the terminal portion being narrower than the base portion, the blade tapering in at least one plane between the base and terminal portions, a first, arcuate edge of the blade, extending between the base and terminal portions, being sharpened and the terminal portion including a second, sharpened edge, the or each blade protruding from the shaft with its terminal portion remote from the shaft and arranged so that the first edge of the or each blade is a leading edge when the shaft rotates in a predetermined direction, and the second sharpened edge trails the first edge during such rotation.

This arrangement may be lain on or inserted into the soil of a minefield or battle area and driven forwardly eg. by means of a pushing or pulling vehicle. Rotation of the shaft causes the first sharpened edge of the or each blade to cut through soil and eg. tree and plant roots, tripwires and cables, thereby freeing any unexploded ordnance such as mines. The trailing, second edge and the arcuate shape of the or each blade then lift such fragments, and other solid objects, to the surface of the minefield, from where they can readily be removed and destroyed or otherwise rendered harmless.

The action of bringing large fragments to the surface is also advantageous when the ground contains very large items of unexploded ordnance, such as complete mines. Such ordnance could damage the cutting assembly. The action of bringing such ordnance to the solid surface makes it visible, thereby permitting rendering the ordnance harmless in a controlled manner.

In preferred embodiments the first, sharpened edge (ie. the leading edge during use of the apparatus) is convexly curved. This assists in bringing solid matter to the surface of the minefield, without subsequently burying it again.

Preferably the cutting assembly includes a drive transferring means for imparting rotational motion to the shaft. Conveniently the assembly includes a support, for the rotatable shaft, that co-acts with one or more said first edges to sever scissile material carried on a said blade during rotation of the shaft. These arrangements allow the cutting assembly to cut through thick and/or tough members such as detonator wires, tripwires and plant matter such as branches and roots.

In preferred embodiments the cutting assembly includes a conveyor disposed adjacent the rotatable shaft and arranged to convey matter from a first location, adjacent the rotatable shaft, to a further location, remote from the rotatable shaft This feature permits the removal, from the vicinity of the shaft and blade(s), of unexploded ordnance, such as landmine fragments, and other solid matter that could cause injury in the event of an explosion nearby. Once removed from the vicinity of the rotatable shaft, the ordnance and other solid matter can be separated from one another and the ordnance rendered harmless.

Conveniently the conveyor is a bucket conveyor including a moveable belt having mounted thereon one or more conveying buckets. It is also preferable that the moveable belt is located and dimensioned so as to permit the or each conveying bucket when at the first location to receive matter cut by the said blade or blades on the shaft, and convey such matter to the further location.

In preferred embodiments the moveable belt is endless and is driven to move the or each conveying bucket between the first and further locations.

The foregoing features advantageously assist the conveyor to remove solid matter from the vicinity of the rotatable shaft and blade(s). In particularly preferred embodiments the conveyor is secured to follow immediately behind the shaft and blades when they are moving forwardly.

Preferably the or each carrying bucket includes a lip that, when the bucket lies adjacent the shaft, extends generally horizontally. This assists the carrying bucket to shovel the matter cut and loosened by the rotating blades. It is also preferable that the lip of the or each bucket is serrated. This feature allows the bucket(s) to pick up solid matter while permitting particulate matter, such as topsoil, to fall back to the ground and remain substantially in situ. Alternatively, parts of the bucket could be perforated to perform the same function.

It is of course desirable that the rotatable shaft, the blades, the support, the buckets and the conveyor are armoured, against detonation of unexploded ordnance and against shrapnel damage. This is advantageously achieved by manufacturing such components from, or including in their construction, blast-resisting materials.

According to a second aspect of the invention there is provided a moveable vehicle comprising a hopper open at one end and having therein one or more moveable grinding elements for grinding to a predetermined size matter conveyed into the hopper via the open end, the hopper including an outlet for ground matter, and the vehicle including operatively secured thereto a cutting assembly as defined herein for preparing grindable matter to be ground by the hopper.

Preferably the cutting assembly is demountably secured to the vehicle. This advantageously permits ready repair and/or replacement of the cutting assembly and vehicle.

In preferred embodiments the vehicle includes an adjuster for adjusting the operative height of the cutter assembly. Typically the adjuster may be such as to permit controlled variation of the depth in soil to which the cutter operates to loosen unexploded ordnance, such as landmine fragments, and other solid matter. The adjuster may also optionally be configured to raise the cutter above ground level, thereby permitting it to clear eg. solid rock over which the vehicle passes.

When the cutting assembly includes a conveyor for conveying matter from a first location, adjacent the rotatable shaft, to a further location remote therefrom, the further location, to which the cutting assembly conveys matter, preferably is a receiving part of a further moveable conveyor substantially interconnecting the further location and the open end of the hopper, the cutting assembly being arranged to deposit matter at the receiving part of the further conveyor, for conveyance into the hopper for grinding.

Conveniently the further conveyor includes a sorter for removing magnetic items from the matter conveyed by the further conveyor.

The foregoing features advantageously permit separation of eg. ferrous shrapnel from the material being conveyed to the hopper. This is desirable because:

i) the shrapnel could cause injury if left in the vicinity of unexploded ordnance;

ii) the shrapnel may reduce the fertility of agricultural land constituting a minefield, if not removed therefrom;

iii) the shrapnel may damage some kinds of grinding mechanism if allowed to enter the hopper; and iv) the shrapnel can give misleading results during a post-clearance minefield audit using conventional ordnance detecting apparatuses such as metal detectors or ground searching radar.

A preferred form of the sorter comprises one or more electromagnets reciprocable between an item attracting position, in which the or each electromagnet attracts magnetic items from the further conveyor to itself; and an item depositing position, remote from the further conveyor; a power source for the or each electromagnet; and a control circuit for selectively switching the or each electromagnet on and off in dependence on its position. Such a sorter is advantageously effective in removing magnetic material.

Conveniently the or each electromagnet is supported on a moveable belt capable of moving the or each electromagnet, and hence any items attracted thereto, in a direction divergent from the direction in which matter is conveyed by the further conveyor. This arrangement ensures that ferromagnetic items are conveyed safely to a location removed from the hopper.

Alternatively the sorter may include an AC field generator that generates a rotating field. An AC field will have differing effects on eg. aluminium and iron based metals. A rotating magnetic field can be used, according to a known effect, to move such metal types in mutually divergent directions.

In preferred embodiments the vehicle includes a receptacle for magnetic material removed from the further conveyor.

This advantageously prevents the magnetic items, that typically are of ferrous materials, from being redistributed on to the cleared minefields. This in turn reduces the risks of injury and pollution arising from the presence of the magnetic items.

Conveniently the vehicle includes a motor having one or more ground engaging members driveably connected to the motor, for providing powered motion of the vehicle. This advantageously allows the vehicle to be self propelled. Also the presence of the motor provides a so-called "power take off" by means of which eg. the cutter may be powered. "Power take off" as used herein includes medical, hydraulic, electrical and pneumatic actuators, drives and drive-transferring components.

According to a third aspect of the invention, there is provided a blade comprising an elongate, arcuate member having a terminal portion of lesser width than a base portion, the blade tapering in width between the base portion and the terminal portion, at least a first edge of the blade, extending between the base and terminal portions, being sharpened, and the terminal portion including a second, sharpened edge.

This blade is particularly suitable for use in a cutter as defined herein; and as part of a grinder forming part of a vehicle as defined herein.

Preferably the blade includes a third, sharpened edge extending between the base and terminal portions. It is also preferable that the first and third, sharpened edges define the shape of the blade, in the plane in which the blade tapers; and optionally that the curvature of the blade occurs in substantially the same plane as that in which the blade tapers.

These features advantageously assist the blade to perform a combined cutting and loosening function when driven through soil.

There now follows a description of preferred embodiments of the invention, by way of non-limiting example, with reference being made to the accompanying drawings in which.

Figure 1:
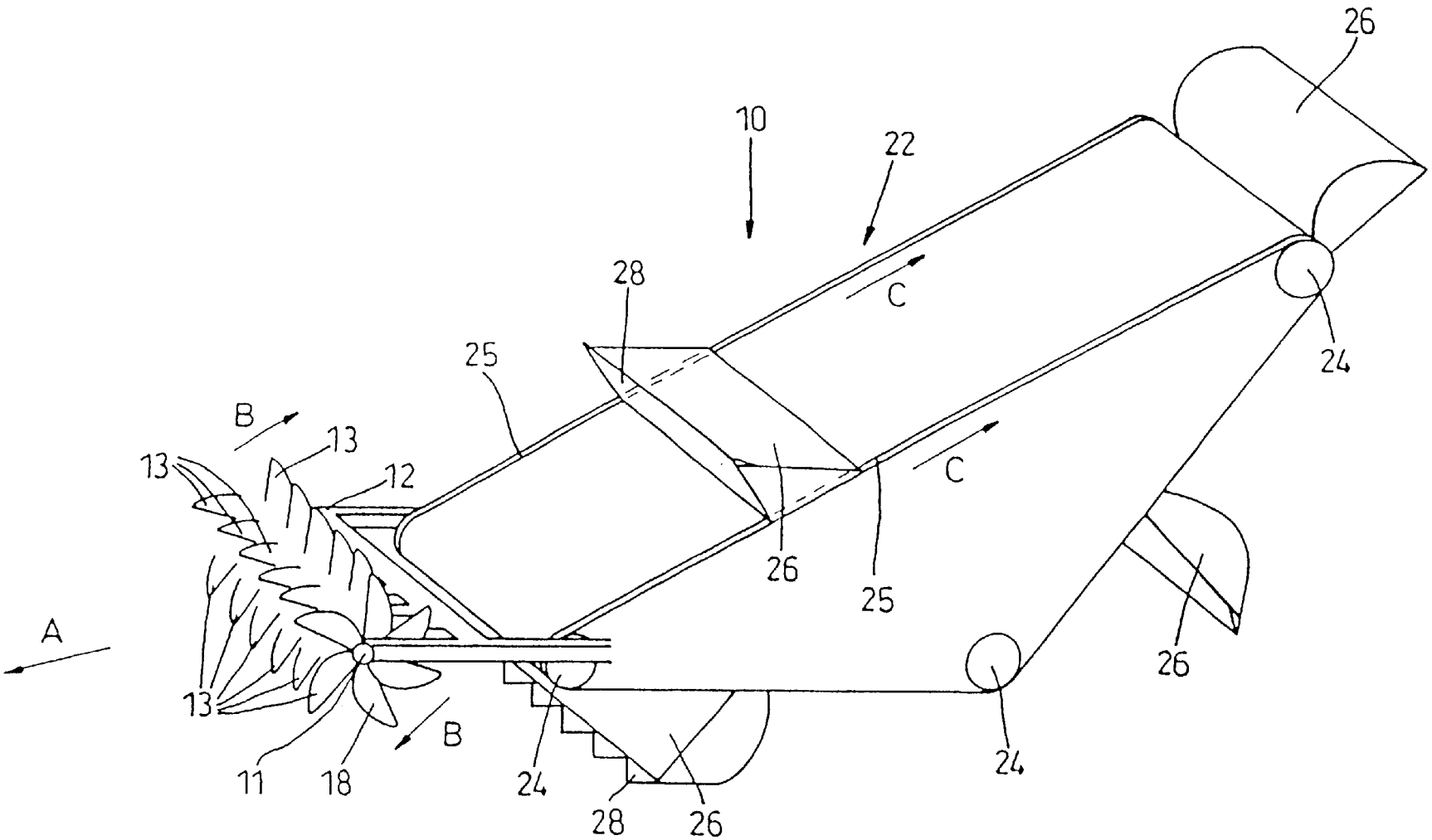
FIGS. 1 and 2 are perspective views of cutting assemblies according to the invention.

Referring to the drawings there is shown a cutting assembly 10 according to the invention.

Cutting assembly 10 includes a rotatable, elongate, circular section shaft 11 that is rotatably journalled at either end in a frame 12 described in more detail below. Shaft 11 is in the embodiment shown mounted for rotation about a horizontal axis, although the shaft could be arranged to lie at another angle if desired.

Shaft 11 supports a plurality of blades 13. Each blade 13 preferably has a base portion 13*a* (FIG. 3) and a terminal portion 13*b* remote from the base portion. The terminal portion 13*b* is narrower than the base portion 13*a*. The blade 13 tapers in at least one plane between the base and terminal portions. This is illustrated in die FIG. 3 embodiment as narrowing of the blade 13 in the plane of the drawing.

Blade 13 includes a first, arcuate, sharpened edge 14 that in the embodiment shown is the convexly curved edge interconnecting the base 13*a* and terminal portions 13*b*.

The terminal portion 13*b* terminates in a second, sharpened edge 16 that in the embodiment shown is straight and resembles a chisel blade, although it could if desired be of another shape (eg. arcuate).

A third, arcuate edge 17, that optionally. is also sharpened, extends between the second edge 16 and the base portion 13*b*, on the opposite side of blade 13 to edge 14.

The third edge 17 is particularly useful when the direction of rotation of the blades (described below) is reversed to clear jams.

The base portion 13*b* of each blade 13 is rigidly secured (eg. by welding or by another means such as a fastener) to the shaft 11 so that each blade protrudes from shaft 11 with its terminal portion 13*b* remote from shaft 11.

A plurality (six in the embodiment shown) of the blades 13 are equispaced about the circumference of shaft 11, with each edge 14 lying adjacent an edge 17 of the next circumferentially adjacent blade, to define a cutting wheel 18. A plurality of the cutting wheels 18 are arranged side by side on the shaft, with the laterally adjacent blades aligned with one another to define an array of blades.

It will be apparent that when the array of blades is driven in the direction of arrow A through eg. soil or mud, and the shaft 11 simultaneously rotated in the direction of the arrows B, the blades 13 tend to loosen and lift the soil, and any items embedded therein to the depth of the radius defined by the blade array. During this motion the sharpened edges 14 and 16 tend to sever any scissile material, such as tree roots, cables and tripwires, that the array of blades encounters.

Frame 12 supports the journal bearings for shaft 11 and secures shaft 11 relative to the remainder of the cutting assembly (described below). Frame 12 also includes a series of optional horizontally extending, parallel guillotines 19 respectively interdigitated with the cutting wheels 18, whereby any scissile material not severed during the upward motion of a blade 13 is carried rearwardly on the blade for guillotining at the guillotines 19.

Figure 2:
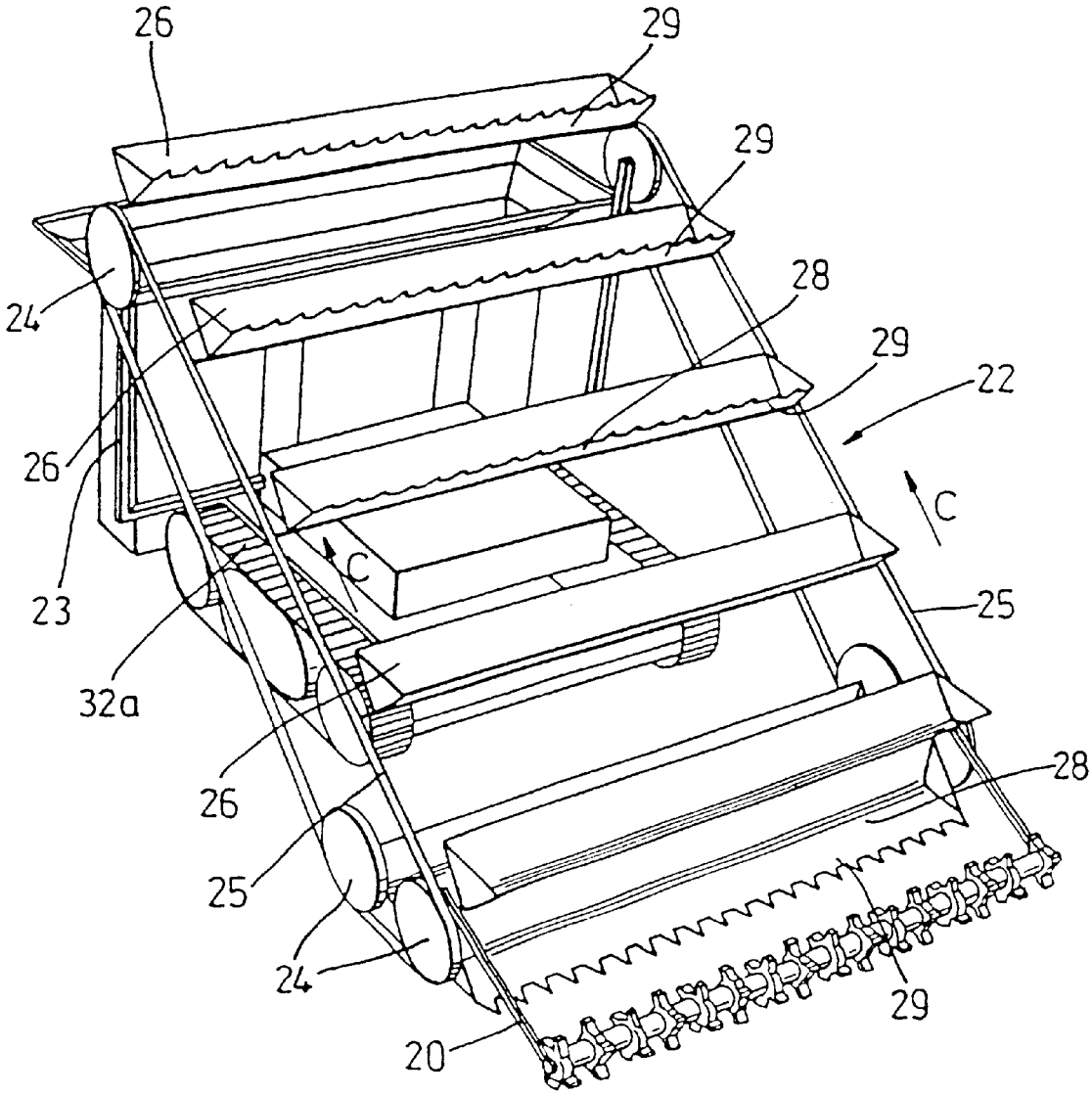

As shown in FIG. 2, which omits the frame 12 for clarity, shaft 12 may be drivingly rotated by an endless drive belt 20 or an equivalent device such as a chain engaged with a drive pulley forming part of a power take off mechanism, and about a driven pulley rigidly secured on the shaft 11. Belt 20 operates in a per se well known manner.

Frame 12 is secured on the forward end of an upwardly inclined conveyor 22. Conveyor 22 includes a framework 23 supporting a series of drive rollers 24 arranged at the apexes of a triangle defining the shape of the conveyor 22. The triangle is orientated so that its hyponteneuse extends inclinedly upwardly from the vicinity of the shaft 11 towards the rear of the cutting assembly.

A pair of spaced apart, parallel, endless drive belts or chains 25 extend about the drive rollers 24. A series of conveyor buckets 26, spaced apart from one another at intervals, are secured at either end to the drive belts or chains, thereby defining an upwardly extending bucket conveyor.

Each bucket 26 is hollow, open on its upper side and substantially triangular in cross section. The forwardmost wall 28 of each bucket protrudes above the remainder of the bucket cross section so as to define a lip 29 extending along the forwardmost edge of each bucket 26. The lip is optionally serrated.

The drive rollers 24 arc rotatable and the belts 25 are drivingly engaged therewith so that rotation of the rollers causes the buckets 26 to travel around the triangular locus defined by the drive belts 25.

The buckets 26 are constrained to follow the triangular locus either by virtue of their securing to the belts 26, or because of an additional constraint such as a guide track engageable by a protrusion on each bucket, with the result that when belts 25 move in the direction of arrows C in the vicinity of roller 11 each bucket travels forwardly towards roller 11 with its wall 28 travelling generally horizontally at ground level. This causes each bucket 26 to scoop up and convey soil and other matter previously loosened and cut by the blades 13.

The drive rollers may be driven to rotate eg. by virtue of a known power take off mechanism connected to a motor.

As is evident from eg. FIG. 1, the travel of the buckets 26 causes them to invert when they reach the uppermost roller 24. This causes each bucket 24 periodically to empty itself, once it has conveyed its content away from roller 11.

Figure 5:
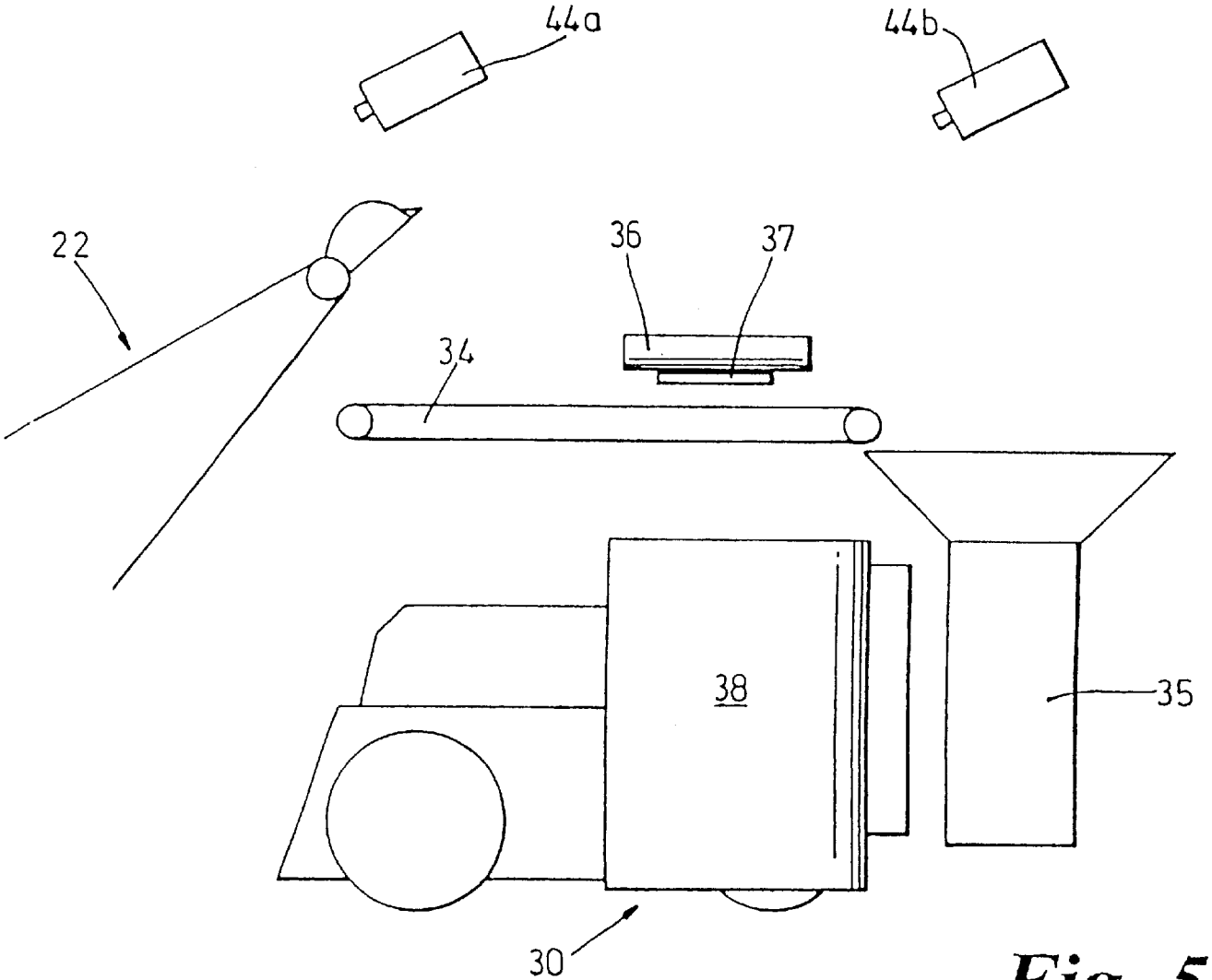
FIG. 5 is a schematic, side elevational view of an embodiment of vehicle according to the invention.
Figure 6:
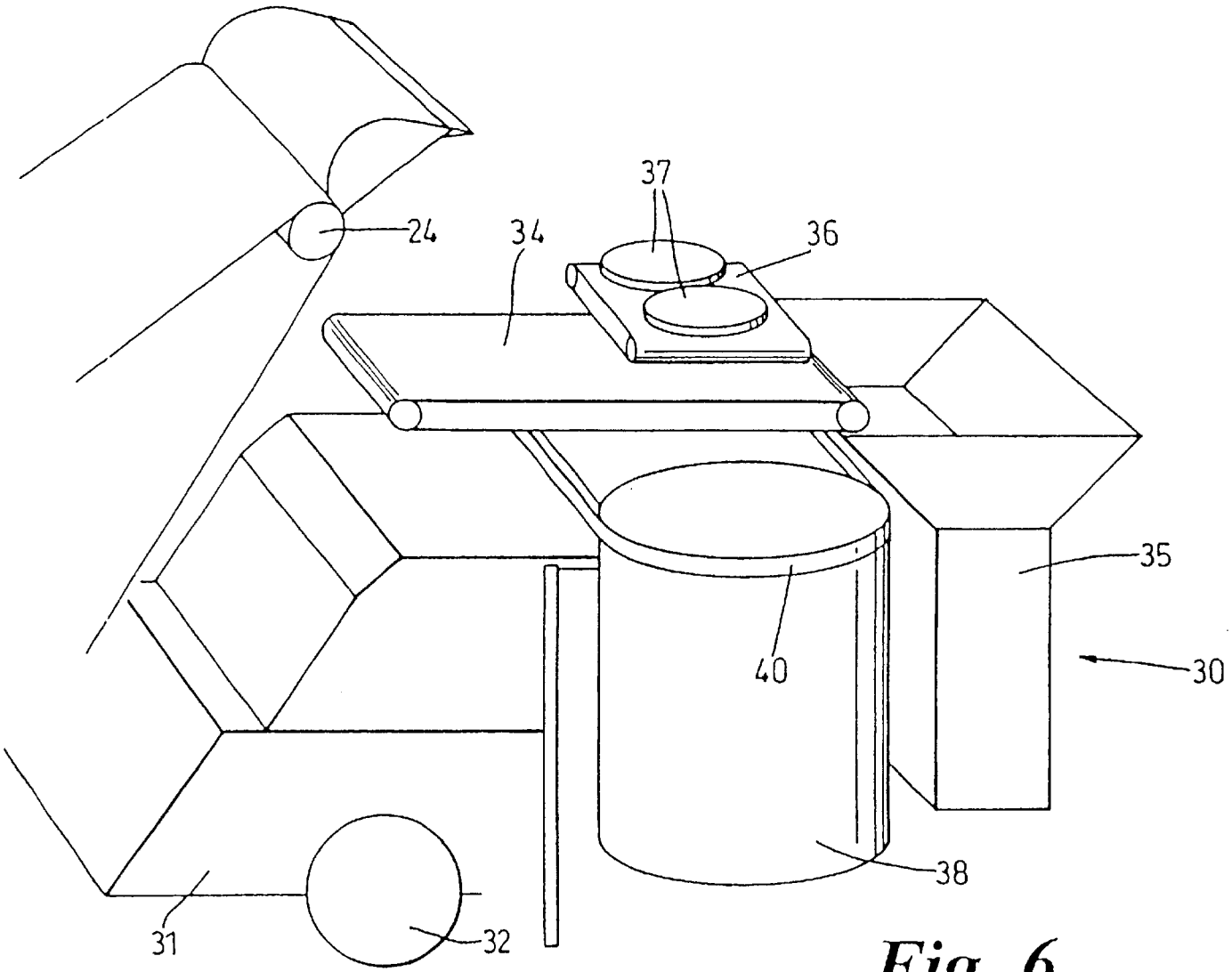
FIG. 6 is a perspective view of part of the vehicle of FIG. 4.

FIGS. 5 and 6 show the cutting assembly of FIGS. 1 and 2 adjacent a vehicle 30 whose purposes are to remove magnetic items from soil cut, loosened and conveyed by cutting assembly 10; and to grind non-magnetic matter, including unexploded ordnance, to a safe size.

Vehicle 30 includes a body 31 housing a motor or engine drivingly connected to ground-engaging components such as conventional wheels 32 as shown, or eg. caterpillar tracks 32*a* (FIG. 2). Body 31 also may house eg. a microprocessor and transceiver assembly of per se known design, whereby the vehicle may be remotely controlled, ie. driverless.

A horizontally extending conveyor belt 34 of known design is secured on top of body 31. Conveyor belt 31 extends rearwardly along vehicle 30, from a position underlying the uppermost roller 24 of bucket conveyor 22, to a position overlying a downwardly extending, hollow, grinding hopper 35 secured on the rear end wall of body 31.

Conveyor belt 34 is driveable in a per se known manner, eg. by means of a power take off from the vehicle motor, whereby it may continuously convey matter emptied from the buckets 26 to the rear of vehicle 30. At the rear of vehicle 30 such matter falls off conveyor 34 into hopper 35, where it is reduced in size.

A further conveyor belt 36 overlies and is spaced from conveyor belt 34 and extends generally perpendicular thereto, or at least diverges therefrom. Further conveyor belt includes secured thereto or integral therewith one or more electromagnets 37 represented schematically in FIG. 5.

Further conveyor belt 36 is driveable eg. by means of a power take off from the vehicle motor. The vehicle 30 includes a switching circuit that is capable of selectively switching the electromagnets 37 on and off.

Further conveyor 36 extends beyond the lateral extent of conveyor belt 34. If the switching circuit is suitably controlled eg. by a microprocessor connected thereto, the further conveyor may serve to remove ferromagnetic items from the matter conveyed on conveyor 34 This is achieved by the electromagnets cycling between energised and de-energised states so that they pick up ferromagnetic items from conveyor 34 and release them once conveyed beyond the lateral extent of conveyor 34.

A hopper or bag 38, depending downwardly and open at its upper end, may be secured beneath conveyor 36 at a location remote from conveyor 34, for catching such ferromagnetic items released from conveyor 36. This prevents the ferromagnetic items from causing contamination or injury.

As indicated herein the electromagnets may be replaced by a generator of an oscillating AC field that discriminates between different metal types.

Hopper or bag 38 may be secured on vehicle 30 by means of a releasable fastening represented schematically in FIG. 5 by a strap 40. The hopper or bag may thereby be periodically removed and exchanged or emptied.

Grinding hopper 35 includes a series of meshing gear shafts that are powered to rotate and break up matter in hopper 35. Such matter moves progressively downwardly through hopper 35 until it reaches the bottom thereof. By the time the ground matter reaches this point any unexploded mine fragments or other ordnance are sufficiently small as to present no series hazard. Such fragments, together with soil and mud, are released from hopper 35 via an aperture.

The shafts may have mounted thereon series of teeth such as teeth 13.

The blades 13, shaft 11, buckets 26, conveyors 34 and 36, hoppers 35 and 38 and the vehicle body 31 may all be manufactured from blast resisting materials in order to maximise the working life of the vehicle in unexploded ordnance clearance operations.

The apparatus of the invention may be used following use of an apparatus as disclosed in EP-A-0 842 388, or eg. a flail-type of ordnance detonating machine. Both types of apparatus are intended to detonate all mines in a minefield but in particular the flail machine may leave substantial, unexploded ordnance in a minefield.

The vehicle 30, having cutting assembly 10 mounted at its forward end, is then driven through the minefield with shaft 11 rotating and the blades 13 repeatedly engaging the soil to a depth determined by the mounting height of the cutting assembly.

Rotation of shaft 11 as previously indicated lifts and loosens the soil and simultaneously cuts any scissile matter. This in turn reduces the power needed to drive conveyor 22 to collect the loosened soil. As they move on the belts 20 the buckets 26 repeatedly scoop up the soil loosened by the blades 13, and convey it rearwardly upwardly away from roller 11. As the buckets 26 invert at the top of their travel, remote from shaft 11, they empty their contents onto moving conveyor belt 24. This conveys such matter rearwardly on the vehicle 30 to the hopper 35, as previously described. During this process the further conveyor 37 operates, also as previously described, to remove ferromagnetic items to the hopper or bag 38.

The depths of the shaft 11 and conveyor 22 may be adjusted as necessary to accommodate changes in ground conditions.

The invention resides in both the combination of the cutting assembly 10 with the vehicle 30; and also in the cutting assembly 10 alone. This latter may if desired be secured to a different kind of vehicle than that shown. Such a vehicle need not be motorised and could for example be manually pushed.

Figure 7:
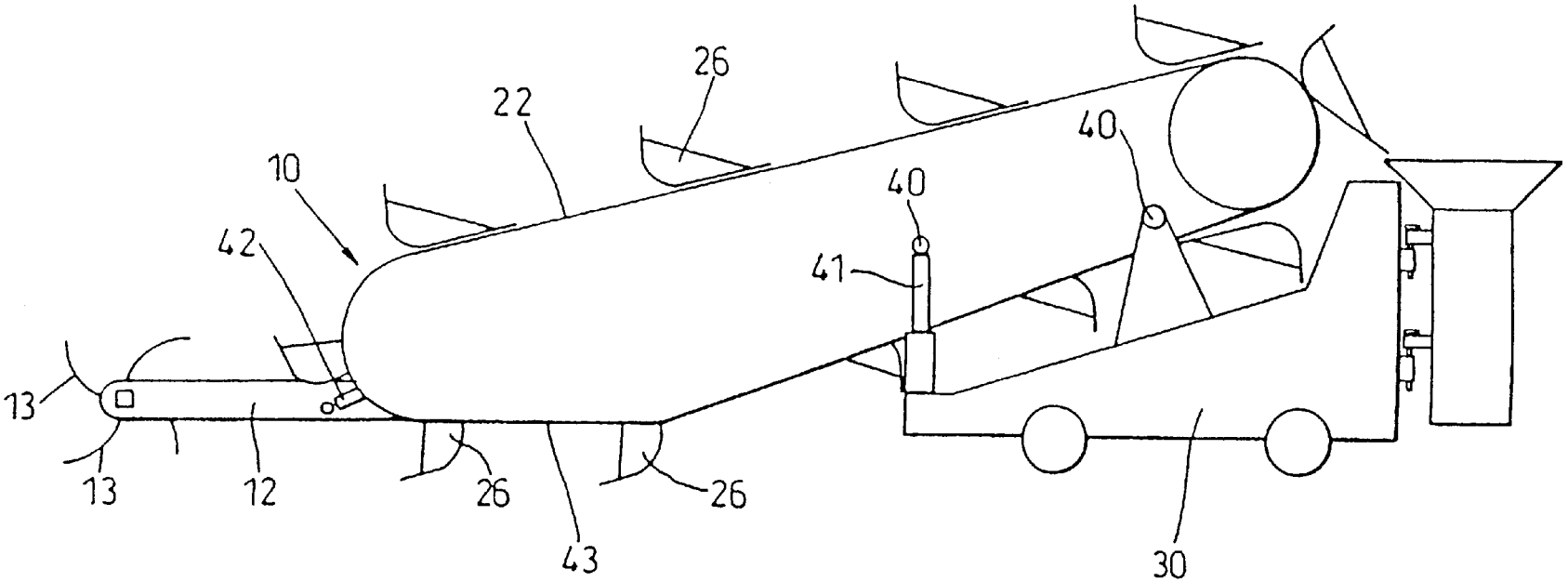
FIG. 7 shows an alternative embodiment of vehicle according to the invention.

An example of an alternative vehicle is illustrated in FIG. 7. This vehicle is motorised and self-propelled but it lacks the conveyors 34 and 36. In this embodiment loosened soil and all items embedded therein are conveyed directly to a temporary storage hopper whose contents can be rendered harmless at a location remote from the minefield, if desired. The temporary storage hopper may of course be replaced by a grinding hopper such as hopper 35.

FIG. 7 shows an optional feature of the cutting assembly, in the form of releasable pin connectors 40 by means of which cutting assembly 10 may readily be removed from the vehicle.

The vehicle 30 of FIG. 7 also includes a vertically acting member such as an hydraulic ram 41 by means of which the angle of conveyor 22 may be adjusted eg. under the control of a microprocessor. If frame 12 is pivotably secured on conveyor 22 or framework 23, a further hydraulic ram 42, similarly controlled, may be used to adjust the depth to which the blades cut and loosen the soil, thereby allowing the apparatus of the invention to operate successfully eg. in peaty minefields.

It is thought desirable to adjust the angle of conveyor 22, the vehicle speed and the speed of conveyor 22 so that each piece of ground is swept by at least two consecutive buckets 26. The underside of conveyor 22 may be flattened as shown at 43 to facilitate this.

Figure 4:
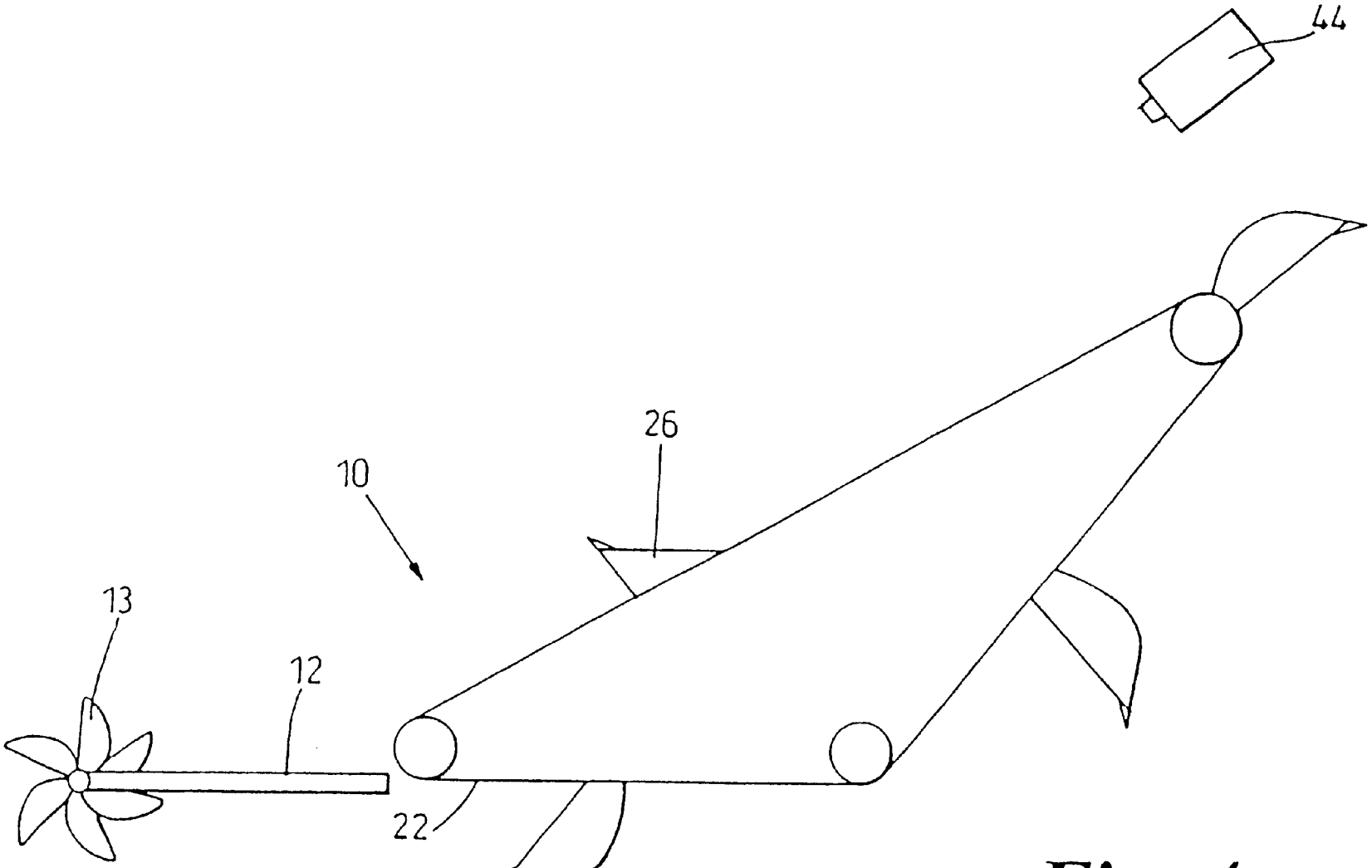
FIG. 4 is a schematic, side elevational view of a cutting assembly similar to that of FIG. 1.

FIGS. 4 and 5 show a further optional feature of the invention, in the form of one or more cameras 44 whereby the operation of the cutting assembly and conveyors may be monitored from a remote location. Camera 44*a* in FIG. 5 is intended to observe large pieces of ordnance that may damage the machinery if they explode; and camera 44*b* observes the remainder of the apparatus.

Yet a further optional feature is a pair of upstanding side guides extending. along each longitudinal edge of conveyor belt 34, to prevent unexploded ordnance from falling off the machine back onto the minefield.

Figure 3:
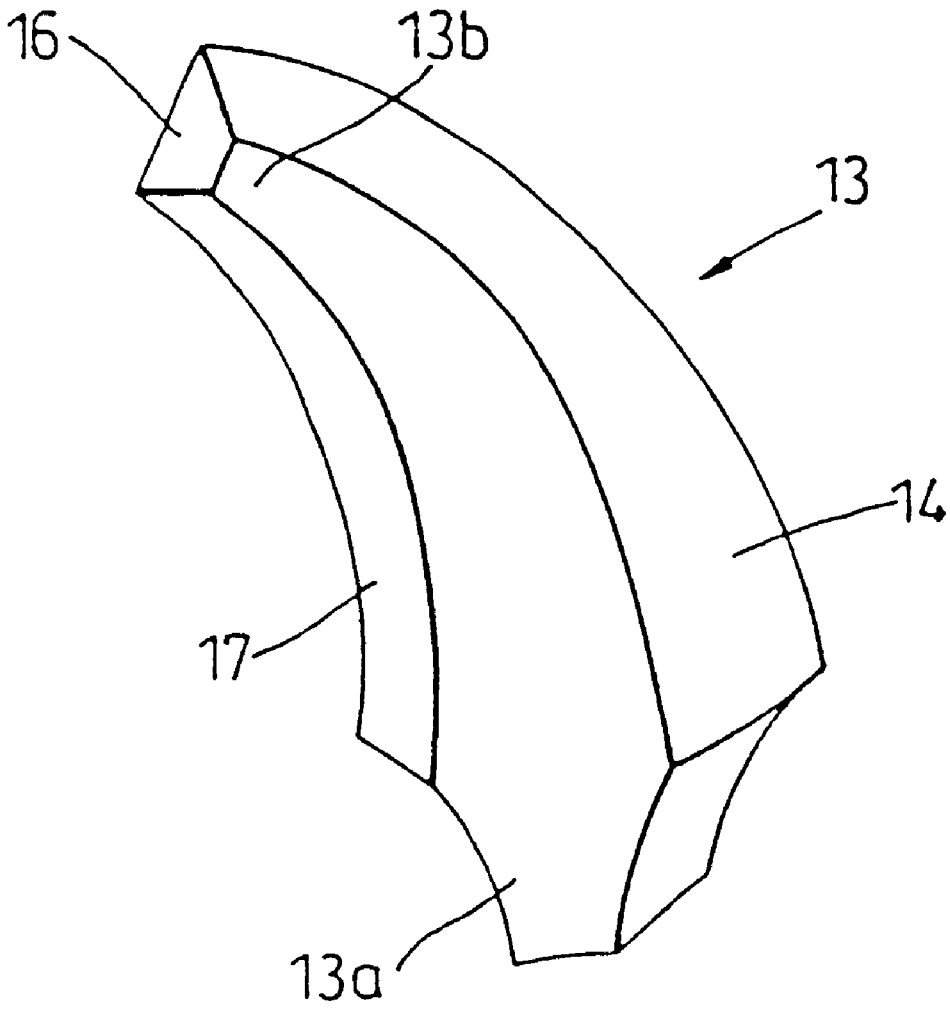
FIG. 3 is a perspective view of a blade, according to the invention, for use in a cutting assembly as shown in FIG. 1.

It is not essential that the blades mounted on shaft 11 have the shape or configuration shown in FIG. 3. However this shape is thought to be particularly suitable and is economical to use in construction of the apparatus, when the same blade design is used in the hopper 35 as aforesaid.

What is claimed is:

1. A cutting assembly comprising a rotatable shaft supporting one or more elongate blade, the or each blade having a base portion and a terminal portion remote from the base portion, the terminal portion being narrower than the base portion, the blade tapering in at least one plane between the base and terminal portions, a first, arcuate edge of the blade, extending between the base and terminal portions, being sharpened and the terminal portion including a second, arcuate sharpened edge, said second edge being curved generally in the same direction as the first said edge, the or each blade protruding from the shaft with its terminal portion remote from the shaft and being arranged so that the first edge of the or each blade is a leading edge when the shaft rotates in a predetermined direction, and the second edge trails the first edge during such rotation.

2. An assembly according to claim 1, including a drive transferring means for imparting rotational motion to the shaft.

3. An assembly according to claim 1 or claim 2, including a support, for the rotatable shaft, that co-acts with one or more said first edges to sever scissile material carried on a said blade during rotation of the shaft.

4. An assembly according to claim 1, including a conveyor, disposed adjacent the rotatable shaft and arranged to convey matter from a first location, adjacent the rotatable shaft, to a further location, remote from the rotatable shaft.

5. An assembly according to claim 4, wherein the conveyor is a bucket conveyor including a moveable belt having mounted thereon one or more conveying buckets.

6. An assembly according to claim 5, wherein the moveable belt is located and dimensioned so as to permit the or each conveying bucket when at the first location to receive matter cut by the said blade or blades on the shaft, and convey such matter to the further location.

7. An assembly according to claim 5, wherein the moveable belt is endless and is driven to move the or each conveying bucket between the first and further locations.

8. An assembly according to claim 5, wherein the or each conveying bucket includes a lip that, when the bucket lies adjacent the shaft, extends generally horizontally.

9. An assembly according to claim 8, wherein the lip is serrated.

10. An assembly, according to claim 1, the shaft and blades of which include a blast-resistant material.

11. An assembly, according to claim 5, the conveying buckets of which include a blast-resistant material.

12. An assembly according to claim 4, wherein the conveyor is spaced from the shaft by a distance of at least 1 m.

13. A moveable vehicle comprising a hopper open at one end and having therein one or more moveable grinding elements for grinding to a predetermined size matter conveyed into the hopper, the hopper including an outlet for ground matter; and the vehicle having operatively secured thereto a cutting assembly according to claim 1, for preparing grindable matter to be ground in the hopper.

14. A vehicle according to claim 13, wherein the cutting assembly is demountably secured to the vehicle.

15. A vehicle according to claim 13, including an adjuster for adjusting the operative height of the cutter assembly.

16. A vehicle according to claim 15, including a conveyor, disposed adjacent the rotatable shaft and arranged to convey matter from a first location, adjacent the rotatable shaft, to a further location, remote from the rotatable shaft, wherein the further location, to which the cutting assembly conveys matter, is a receiving part of a further moveable conveyor substantially interconnecting the further location and the open end of the hopper, the cutting assembly being arranged to deposit matter at the receiving part of the further conveyor, for conveyance into the hopper for grinding.

17. A vehicle according to claim 15, wherein the further conveyor includes a sorter for removing magnetic items from the matter conveyed by the further conveyor.

18. A vehicle according to claim 17, wherein the sorter comprises one or more electromagnets reciprocable between an item attracting position, in which the or each electromagnet attracts magnetic items from the further conveyor to itself; and an item depositing position, remote from the further conveyor; a power source for the or each electromagnet; and a control circuit for selectively switching the or each electromagnet on and off in dependence on its position.

19. A vehicle according to claim 18, wherein the or each electromagnet is supported on a moveable belt capable of moving the or each electromagnet, and hence any items attracted thereto, in a direction divergent from the direction in which matter is conveyed by the further conveyor.

20. A vehicle according to claim 17, wherein the sorter includes an AC field generator, capable of generating an oscillating or rotating field output, for discriminating between different metal types.

21. A vehicle according to claim 19, including a receptacle for magnetic material removed from the further conveyor.

22. A vehicle according to claim 14 when dependent from claim 14, including a motor and having one or more ground engaging members driveably connected to the motor, for providing powered motion for the vehicle.

23. A blade for a cutting assembly according to claim 1, the blade comprising an elongate, arcuate member having a terminal portion of lesser width than a base portion, the blade tapering in width between the base portion and the terminal portion, at least a first edge of the blade, extending between the base and terminal portions, being sharpened, and the terminal portion including a second, sharpened, arcuate edge, characterised in that the second said edge curves in generally the same direction as the first said edge.

24. A blade according to claim 23, including a third, sharpened edge extending between the base and terminal portions.

25. A blade according to claim 24, wherein the first and third, sharpened edges define the shape of the blade, in the plane in which the blade tapers.

26. A blade according to claim 23, wherein the curvature of the blade occurs in substantially the same plane as that in which the blade tapers.

* * * * *